US007426963B2

(12) United States Patent
O'Neill

(10) Patent No.: US 7,426,963 B2
(45) Date of Patent: Sep. 23, 2008

(54) PIGGABLE FLOWLINE-RISER SYSTEM

(75) Inventor: Marguerite E. O'Neill, Boulder, CO (US)

(73) Assignee: ExxonMobil Upstream Research Company, Houston, TX (US)

( * ) Notice: Subject to any disclaimer, the term of this patent is extended or adjusted under 35 U.S.C. 154(b) by 138 days.

(21) Appl. No.: 10/569,151

(22) PCT Filed: Sep. 20, 2004

(86) PCT No.: PCT/US2004/031033

§ 371 (c)(1),
(2), (4) Date: Feb. 21, 2006

(87) PCT Pub. No.: WO2005/042905

PCT Pub. Date: May 12, 2005

(65) Prior Publication Data

US 2007/0012451 A1 Jan. 18, 2007

Related U.S. Application Data

(60) Provisional application No. 60/512,709, filed on Oct. 20, 2003.

(51) Int. Cl.
*E21B 29/12* (2006.01)

(52) U.S. Cl. ..... 166/365; 166/368; 166/70

(58) Field of Classification Search ..... 166/70, 166/368, 335, 339, 347, 366; 137/242; 15/3.5; 134/22.11, 22.12
See application file for complete search history.

(56) References Cited

U.S. PATENT DOCUMENTS

| | | | | |
|---|---|---|---|---|
| 3,562,014 | A * | 2/1971 | Childers et al. | 134/8 |
| 3,877,520 | A * | 4/1975 | Putnam | 166/366 |
| 4,528,041 | A | 7/1985 | Rickey et al. | 134/8 |
| 4,574,830 | A * | 3/1986 | Rickey et al. | 137/242 |
| 4,709,719 | A * | 12/1987 | Littleton et al. | 137/268 |
| 4,930,938 | A | 6/1990 | Rawstron et al. | 405/204 |
| 5,379,844 | A | 1/1995 | Glasscock et al. | 166/358 |
| 5,437,302 | A * | 8/1995 | Da Silva et al. | 137/242 |
| 5,842,816 | A * | 12/1998 | Cunningham | 405/170 |

(Continued)

FOREIGN PATENT DOCUMENTS

GB 2028400 8/1979

(Continued)

OTHER PUBLICATIONS

Brown, P. G. et al. (1990) "Piggable Pipeline WYE Connection - Development and Design," *Advances in Subsea Pipeline Engineering and Technology*, v. 24, Soc. for Underwater Tech., Netherlands, pp. 207-227.

(Continued)

*Primary Examiner*—Thomas A Beach

(57) ABSTRACT

This invention relates to a flowline-riser production system for the recovery of hydrocarbons from offshore wells, and a method for pigging the interior surfaces of the riser and flowlines. More particularly, this invention is a piggable flowline-riser system in which a pig is launched from or near a host production facility, down a riser into a looped flowline and returned up through the same riser. According to one embodiment of the invention, there is a piggable flowline-riser system for producing hydrocarbons comprising a riser, a "Y" joint and a looped flowline, wherein the looped flowline is in fluid communication with at least one subsea well.

17 Claims, 9 Drawing Sheets

U.S. PATENT DOCUMENTS

| | | | | |
|---|---|---|---|---|
| 5,857,715 | A | 1/1999 | Gray et al. | 285/131.1 |
| 5,890,531 | A * | 4/1999 | Gairns et al. | 165/95 |
| 6,079,498 | A | 6/2000 | Lima et al. | 166/370 |
| 6,139,644 | A * | 10/2000 | Lima | 134/8 |
| 6,182,761 | B1 * | 2/2001 | Bednar | 166/339 |
| 6,267,182 | B1 * | 7/2001 | Lima | 166/335 |
| 6,336,238 | B1 * | 1/2002 | Tarlton | 15/3.5 |
| 6,533,032 | B1 * | 3/2003 | Seixas et al. | 166/70 |
| 6,536,461 | B2 * | 3/2003 | Decker et al. | 137/268 |
| 6,679,949 | B2 * | 1/2004 | De Almeida | 134/8 |
| 2003/0170077 | A1 * | 9/2003 | Herd et al. | 405/224.2 |

FOREIGN PATENT DOCUMENTS

| | | |
|---|---|---|
| GB | 2191229 | 3/1986 |
| GB | 2196716 | 9/1987 |
| WO | WO 95/12464 | 5/1995 |
| WO | WO 01/71158 | 9/2001 |
| WO | WO 01/73261 | 10/2001 |

OTHER PUBLICATIONS

Cordell, J. L. (1992) "Pipeline Pigging and Integrity Monitoring: Where Are We Now, and Where Are We Going," *Pipeline Pigging and Integrity Monitoring Conference, Amsterdam, Netherlands Sep. 28-Oct.1, 1992*, 10 pages.

Herve, J. L. (1989) "T and Y Conncections: North Sea Design," *Pipelines for Marginal Fields Conference, Dyce Scotland*, pp. 237-253.

Horvel, K. (1999) "The VVK Valve, " *Soc. Underwater Technol Ocean & Sci & Offshore Eng. Serv.*, v. 20 pp. 143-164. (ISBN: 1-85333-302-6).

Kozel, T. (1996) "Subsea Pigging Considerations," *The Pipeline Pigging Conference, Houston, Texas, Feb. 14-16, 1996*, 16 pages.

Kozel, T. (1999) "System Design for Subsea Pigging," *10th Pipes Pipeline Pigging International Conference, Houston, Texas, Feb. 2-5*, Proc. paper No. 18, 15 pages.

Lino, A.C.F. et al. (1995) "Pigging in Deep-Water Installations," *7th Pipeline Gas Ind & Pipes Pipelines Int. Pipeline Pigging International Conference, Houston, Texas, Feb. 13-16, 1995*, Proc. Paper No. 14, 14 pages.

Lino, A.C.F. et al. (1997) "The Engineering of Pigging Equipment for Subsea Systems in Campos Basin," *Offshore Technology Conference, Houston, Texas, May 5-8, 1997*, pp. 455-469.

Phillips, D. (1991) "Subsea Pipeline Connections: An Alternative to Additional Platform Risers," *IBC Tech Serv., Ltd. Offshore Satellite Development Conference, London, England, May 13-14, 1991*, 5 pages.

Redningen, M. (1986) "Design of Piggable Subsea Connections," *Subsea Pigging-Norway, Haugesund, Norway, Sep. 23-25*, 11 pages.

Vingerhagen, A. et al. (1998) "Design & Development of Multi-Diameter Pigs," *Pipeline Gas Journal*, v.225, No. 3, pp. 54-57. (ISSN: 00320188).

Vingerhagen, A. et al. (1999) "The Design and Development of Multi-Diameter Pigs for Pipelines and Flexible Risers," *10th Pipes Pipeline Pigging International Conference, Houston, Texas, Feb. 2-5*, Proc. Paper No. 17, 14 pages.

European Search Report No. RS110646US dated Mar. 29, 2004, 3 pages.

PCT International Search and Written Opinion, mailed Jul. 65, 2005 for PCT/US04/31033 (2003UR030), 5 pages.

ExxonMobil Uptstream Research Company Literature Search dated Nov. 29, 1999, 34 pages.

ExxonMobil Upstream Research Company Patent Search dated Nov. 29, 1999, 26 pages.

* cited by examiner

PIGGABLE FLOWLINE-RISER SYSTEM

CROSS REFERENCE TO RELATED APPLICATIONS

This application is the National Stage of International Application No. PCT/US04/31033, filed 20 Sep. 2004 and claims the benefit of U.S. Provisional Application 60/512,709, filed 20 Oct. 2003.

FIELD OF THE INVENTION

This invention relates to a flowline-riser production system for the recovery of hydrocarbons from offshore wells, and a method for pigging the interior surfaces of the riser and flowlines. More particularly, this invention is a piggable flowline-riser system in which a pig is launched from or near a host production facility, down a riser into a looped flowline and returned up through the same riser.

BACKGROUND

More than two-thirds of the Earth is covered by oceans. As the petroleum industry continues in its search for hydrocarbons, it is finding that more and more of the untapped hydrocarbon reservoirs are located beneath the oceans, in "offshore" reservoirs. A typical system used to produce hydrocarbons from offshore reservoirs comprises a host production facility located on the surface of the ocean or on land, hydrocarbon producing wells located on the ocean floor (i.e. "subsea" wells) and a system of pipes that transports the hydrocarbons from the subsea wells to the host production facility.

In the offshore application, the system of pipes that transport the hydrocarbons within this production system is made up of flowlines and risers. Flowlines are typically referred to in the industry as the portion of pipes that lie on the floor of the body of water. Risers typically refer to the portion of pipes that extend from the flowlines through the water column to the host production facility.

To maintain the production capacity of the flowlines and risers, the interior of the pipes must often be cleaned of various debris or hydrocarbon wastes that can accumulate within such pipes. During fabrication and installation of the flowlines and risers, solid particles in the form of construction debris can accumulate inside the pipes, and these solids need to be removed before starting the hydrocarbon production to ensure the solids are not carried into the production equipment on the host production facility. During production, the produced fluids will typically comprise a mixture of crude oil, gases such as methane, hydrogen sulfide and carbon dioxide, water and sometimes solids, such as sand. The solid materials entrained in the produced fluids may be deposited during "shut-ins," i.e. production stoppages, and require removal. Also, changes in temperature, pressure and/or chemical composition along the pipes may cause the deposition of other materials, such as methane hydrates, waxes or scales, on the internal surface of the flowlines and risers. These deposits need to be periodically removed, as build-up of these materials can reduce line size and constrict flow.

The flowlines and risers must also be inspected on a periodic basis to detect potential problems that may arise in the system. For instance, the presence of corrosive components in the produced fluids, such as hydrogen sulfide and carbon dioxide, may cause corrosion in the flowlines and risers. Periodic monitoring or inspections are required to detect potential corrosion of the lines.

A common method for cleaning the interior of the risers and flowlines and performing inspections is to "pig" the system. One class of pigs is designed for line cleaning, removing wax deposits and/or other debris. The pig scrapes or dislodges the deposits and/or debris from the internal surface of the pipes. Another type of pig is the "intelligent" pig, which has the capability of inspecting the flowline-riser system, for instance, a pig that can measure the wall thickness of the lines and therefore provide data to anticipate potential corrosion problems.

For any piggable system, there must be a means of getting the pig into the system, a method of propelling the pig through the system, and a way to remove the pig from the system. A common piggable flowline system for subsea wells comprises two flowlines and two risers, which are "tied" together. A typical example of such a system is provided in FIG. 1. With this configuration, a pig is sent from the host production facility 5A down a first riser 10A, into a first flowline 30A, through a flowline, sometimes called a pigging loop, 40A connecting wells 35A and 45A, through second flowline 50A, and up through a second riser 10Z back to the host production facility 5A. In the simplest form, all the lines in the system are of constant diameter. Variations of this approach feature lines of different diameters—typically a smaller-diameter riser and flowline for carrying the pig out from the host production facility, and a larger-diameter flowline and riser for returning the pig back to the host production facility. Another variation would be for first and second flowlines 30A and 50A to connect to a manifold used to commingle the production from several wells. The pigging loop 40A can be part of the manifold.

Another common pigging approach uses a subsea pig launcher. As shown in FIG. 2, the subsea pig launcher 75 attaches to the flowline 30B near the subsea well 35B, and from there launches a pig into the flowline 30B, up through the riser 10B and to the host production facility 5B. Because the pig is launched from the ocean floor and retrieved at the surface of the ocean at the host production facility 5B, a second riser is not required. Accordingly, a single flowline 30B and a single riser 10B can be used for producing hydrocarbons from the subsea well(s), while maintaining piggability of the system. However, because the launcher is located at the ocean floor, it must initially be "loaded" with multiple pigs. In order to provide long-term pigging capabilities the launcher has to be reloaded later in field life, which typically requires intervention with a remotely-operated vehicle (POV) or a diver. Moreover, difficulty arises when in a particular instance the flowline-riser system requires the use of a different type of pig than is available in the launcher, e.g. an intelligent pig instead of a cleaning pig. Such instances also typically require the intervention of an ROV or a diver. Additional related references can be found in WO 01/71158 to Kvaerner Oilfield products AS, GB 2,028,400 to Otis Engineering Corporation, WO 01/73261 to Rockwater Limited et al., U.S. Pat. No. 4,528,041 to Rickey et al., U.S. Pat. No. 6,079,498 to Sidrim et al., GB 2,191,229 to Subsea Developments Ltd., WO 95/12464 to Norsk Hydro AS et al., and GB 2,196,716 to Seanor Engineering AS et al.

The systems described above can be effective, but can also be relatively expensive to install and operate. The two-line system shown in FIG. 1 is costly because it requires the fabrication and installation of two separate risers and flowlines. The subsea pig launcher shown in FIG. 2 requires an initial capital investment in the launcher, and also incurs high operating costs associated with bringing additional pigs to the launcher, i.e., with an ROV or a diver.

There is a need in the industry, especially in deepwater applications, to reduce the cost of the offshore development and production of hydrocarbons. Accordingly, what is needed is a piggable offshore system that eliminates the costs of additional equipment and/or maintenance. By reducing the expense of the installation and maintenance of additional risers, and eliminating the expense of the installation and maintenance of the subsea pig launcher while providing a piggable offshore hydrocarbon recovery system, the current invention satisfies this need.

SUMMARY OF THE INVENTION

According to the invention, there is a piggable flowline-riser system for producing hydrocarbons comprising a riser, a "Y" joint and a looped flowline, wherein the looped flowline is in fluid communication with at least one subsea well. More particularly, described is a piggable flowline-riser system comprising a Y joint having a stem and a first and second branch, a riser in fluid communication with the stem of the Y joint, and a looped flowline in fluid communication with at least one subsea well, wherein the looped flowline has a first end and a second end in fluid communication with the first and second branches of the Y joint.

Also provided is a method for pigging the flowline-riser system of the current invention where the flowline-riser system includes a Y joint having a stem in fluid communication with a riser and two branches, each of the branches in fluid communication with one of the ends of a flowline loop, the flowline loop being in fluid communication with at least one subsea production well. The method including ceasing hydrocarbon production from the at least one subsea production well, injecting a pig into the riser, passing the pig from the riser through the Y joint and into the looped flowline, returning the pig from the looped flowline into the Y joint, and passing the pig from the Y joint into the riser.

DETAILED DESCRIPTION OF THE INVENTION

Figure 1:
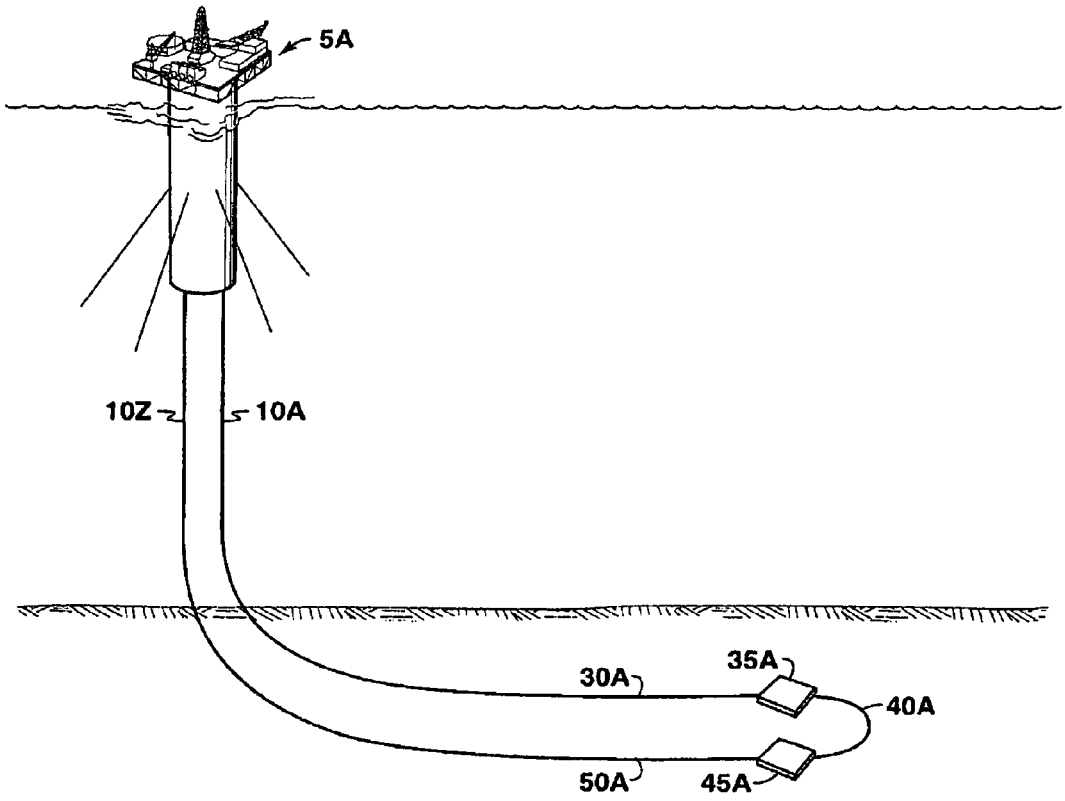
FIG. 1 (Prior Art)
FIG. 1 is a diagram of a piggable subsea production system, featuring two risers and two flowlines.
Figure 2:
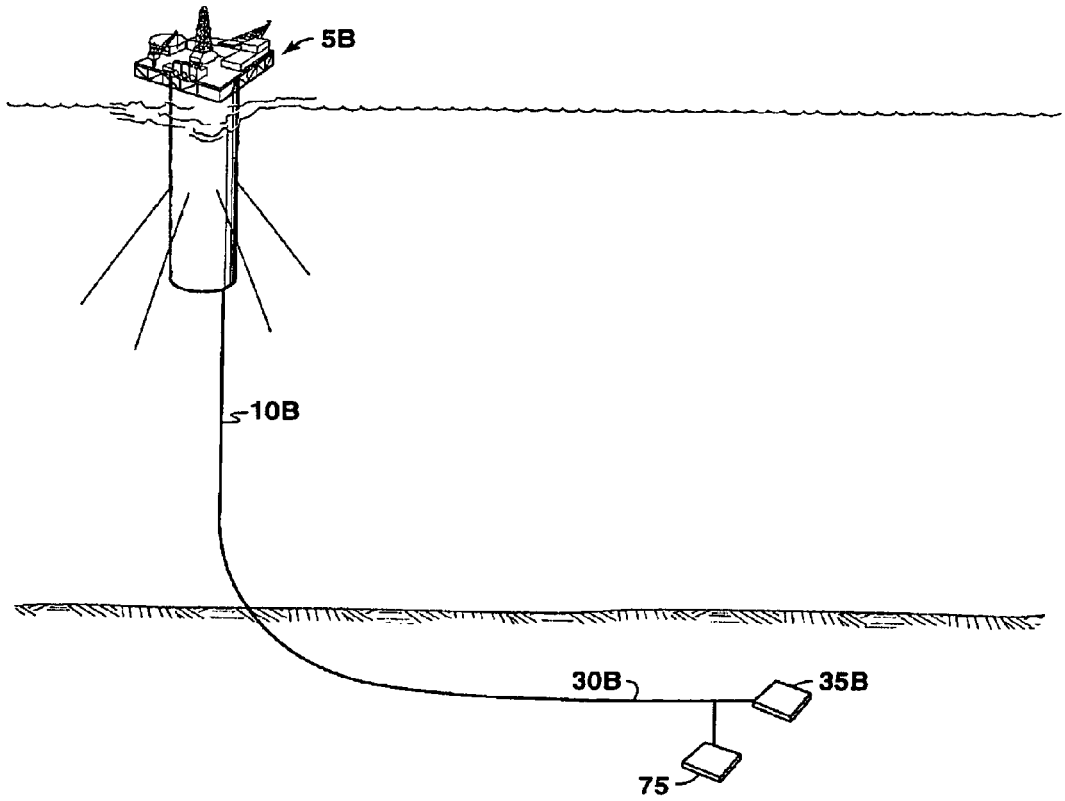
FIG. 2 (Prior Art)
FIG. 2 is diagram of piggable subsea production system featuring one riser, one flowline and a reloadable subsea pig launcher.
Figure 3:
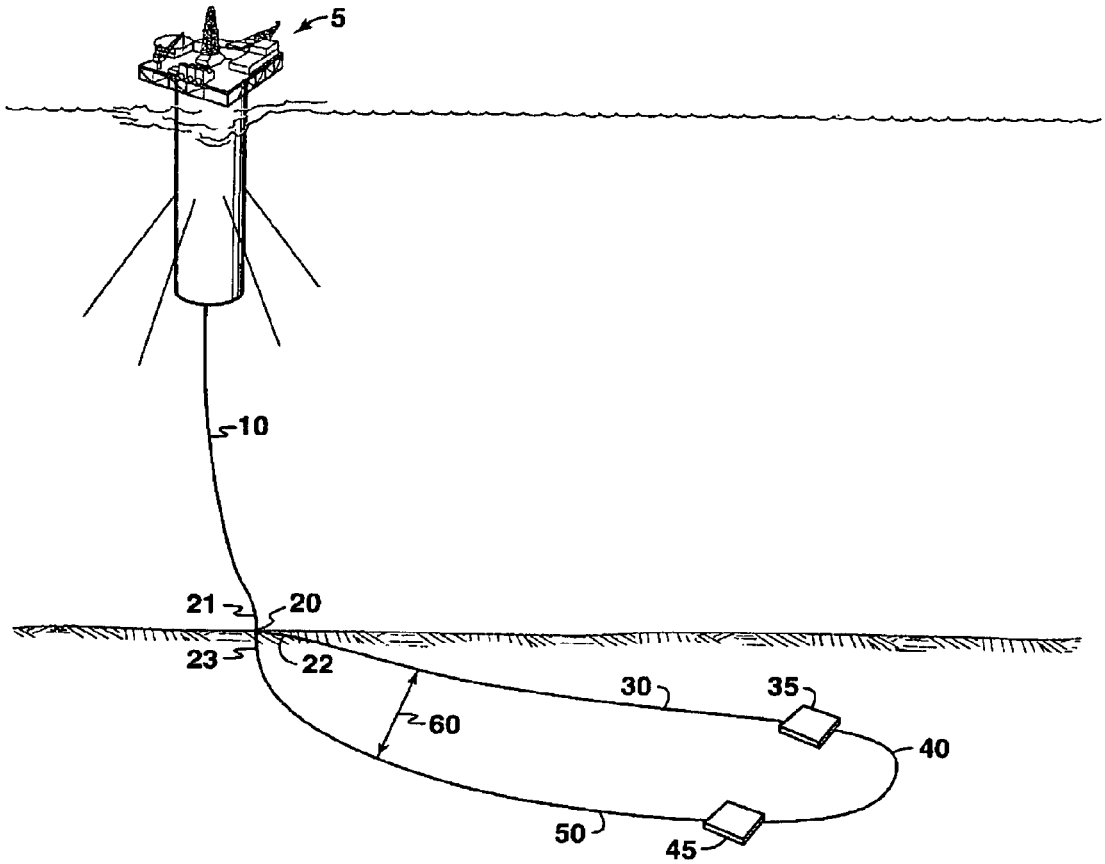
FIG. 3 is a diagram of an embodiment of the current invention, featuring a piggable system comprising a riser, a "Y" joint and a looped flowline.
Figure 4:
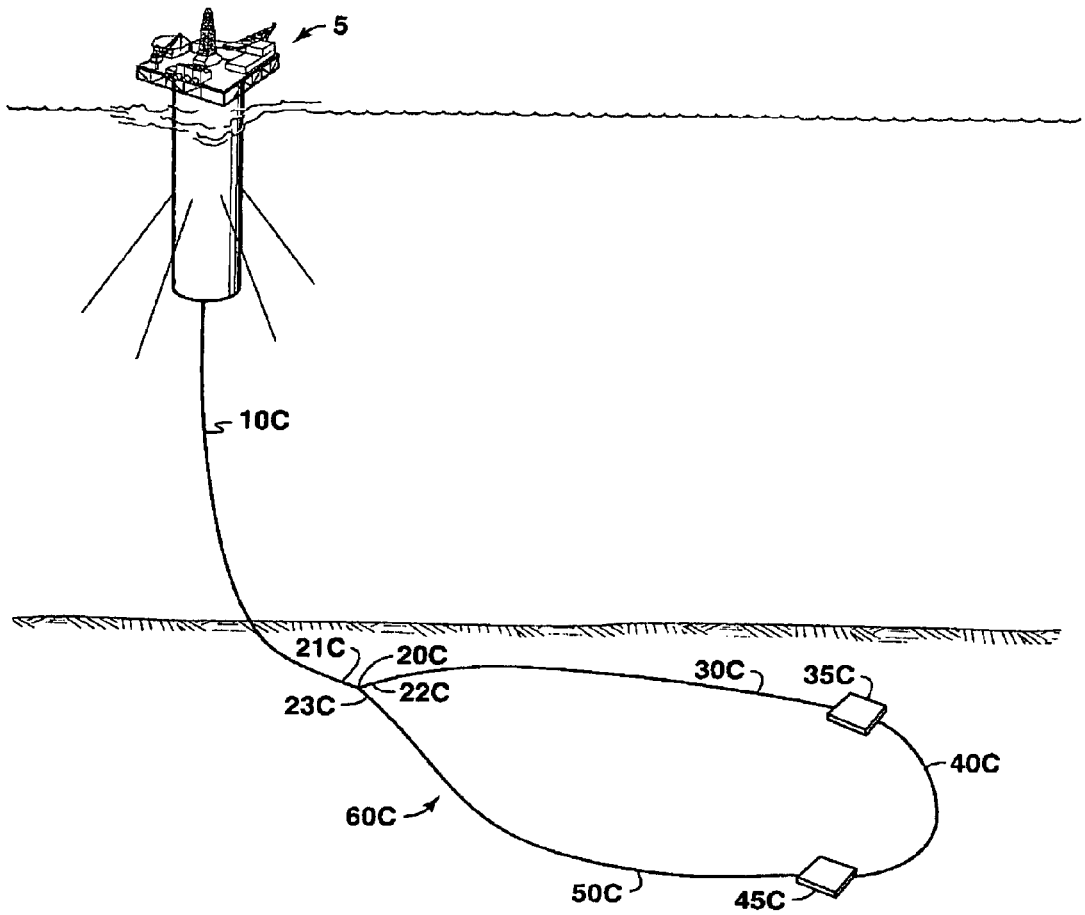
FIG. 4 is a diagram of an embodiment of the current invention, featuring a piggable system comprising a riser, a "Y" joint located on the sea floor and a looped flowline.

The invention includes a piggable flowline-riser system that is capable of supporting the production of hydrocarbon resources (e.g. oil and gas) from subsea wells using a single riser and a looped flowline. With reference to FIGS. 3 and 4, an embodiment of the flowline-riser system is shown with a host surface facility 5, a riser 10 and a looped flowline 60. At the base of the riser 10 is a specialty hardware device called a piggable "Y" joint 20. The stem 21 of the "Y" joint 20 is connected to and is in fluid communication with the riser 10. The two branches 22 and 23 of the "Y" joint 20 are connected to and in fluid communication with flowlines 30 and 50, respectively, which form the two ends of flowline loop 60. For the purposes of this disclosure, the flowline will be referred to as a single flowline, although it should be understood that the flowline may comprise several flowlines connected in a series. For example in FIG. 3, the flowline loop 60 may be formed by flowline 30, flowline 40 and flowline 50. The diameters of the flowline(s) and the riser may be identical, or may vary. Flowlines and risers are commonly used in offshore production of hydrocarbons, and the selection and installation of such lines can be made by one of ordinary skill in the art.

The flowline loop 60 is in fluid communication with one or more production wells or sources of the hydrocarbon product, for example shown in FIG. 3 as subsea wells 35 and 45. Fluid communication between the production wells and the flowline may be accomplished through a conventional production tree (not shown). Appropriate valves contained in the production tree can be activated to isolate the flowlines from the source of the hydrocarbon products.

The host production facility 5 may be any facility used in the offshore production of hydrocarbons. Such facilities include, but are not limited to "fixed" structures such as a jacket or a compliant tower, "floating" structures such as a tension-leg platform, spar or deep-draft caisson vessel (DDCV), and land-based facilities connected by the flowline-riser system with offshore wells.

Figure 5:
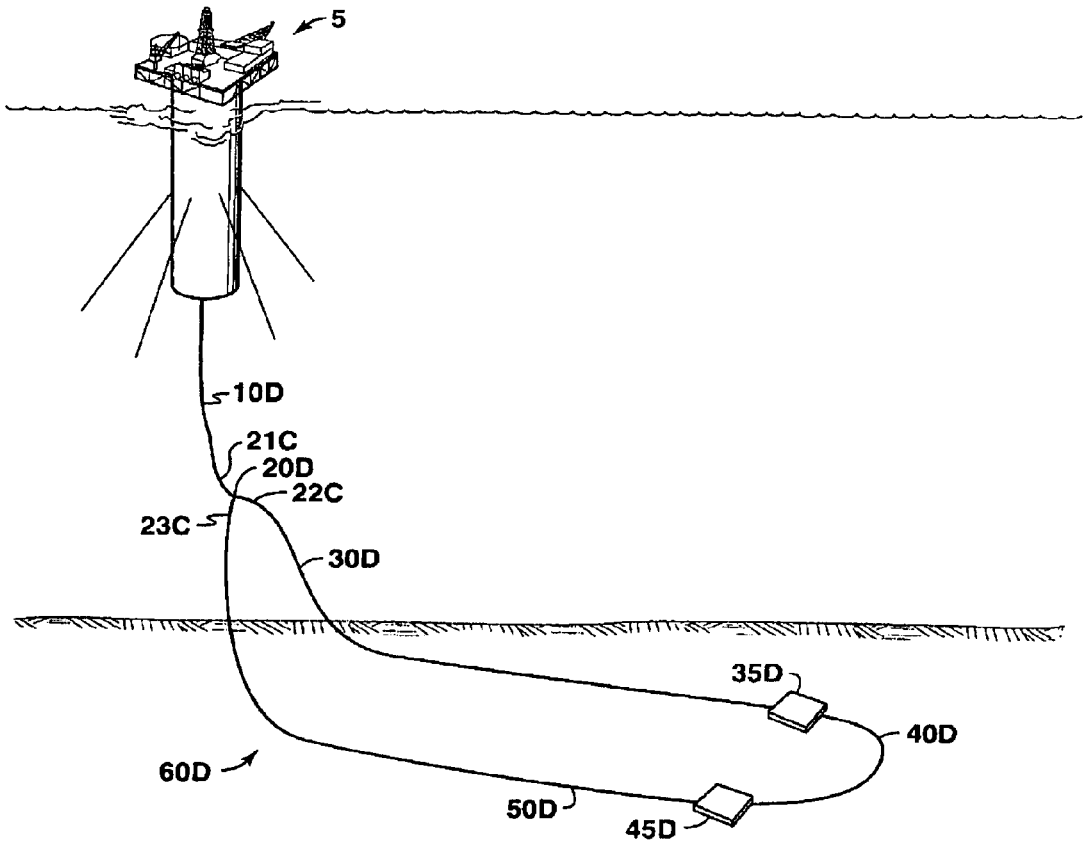
FIG. 5 is a diagram of an embodiment of the current invention, featuring a piggable system comprising a riser, a "Y" joint located in the ocean column and a looped flowline.

For the purposes of this invention, including the claims, the term riser is intended to refer to that portion of the system of pipes located above the "Y" joint, i.e. piping that connects the "Y" joint to the host production facility. The term flowline shall refer to that portion of the system of pipes located below the "Y" joint, i.e. piping that connects the "Y" joint with the subsea wells. This distinction is made from the traditional definitions of "risers" and "flowlines," previously discussed, to clarify that the location of the "Y" joint is not limited to the intersection of the seabed floor and the ocean water column. The embodiment shown in FIG. 3 provides the "Y" joint 20 as being located at the interface between the ocean water column and the ocean floor. However, it is understood that the "Y" joint 20 may be located within the water column or may lie on the ocean floor. For example, as shown in FIG. 4 the "Y" joint 20C is located on the ocean floor with parts of the riser 10C laying on the ocean floor. In contrast, as shown in FIG. 5, the "Y" joint 20D is located within the ocean water column. Accordingly, parts of the flowline loop 60D extend into the ocean water column.

Figure 6:
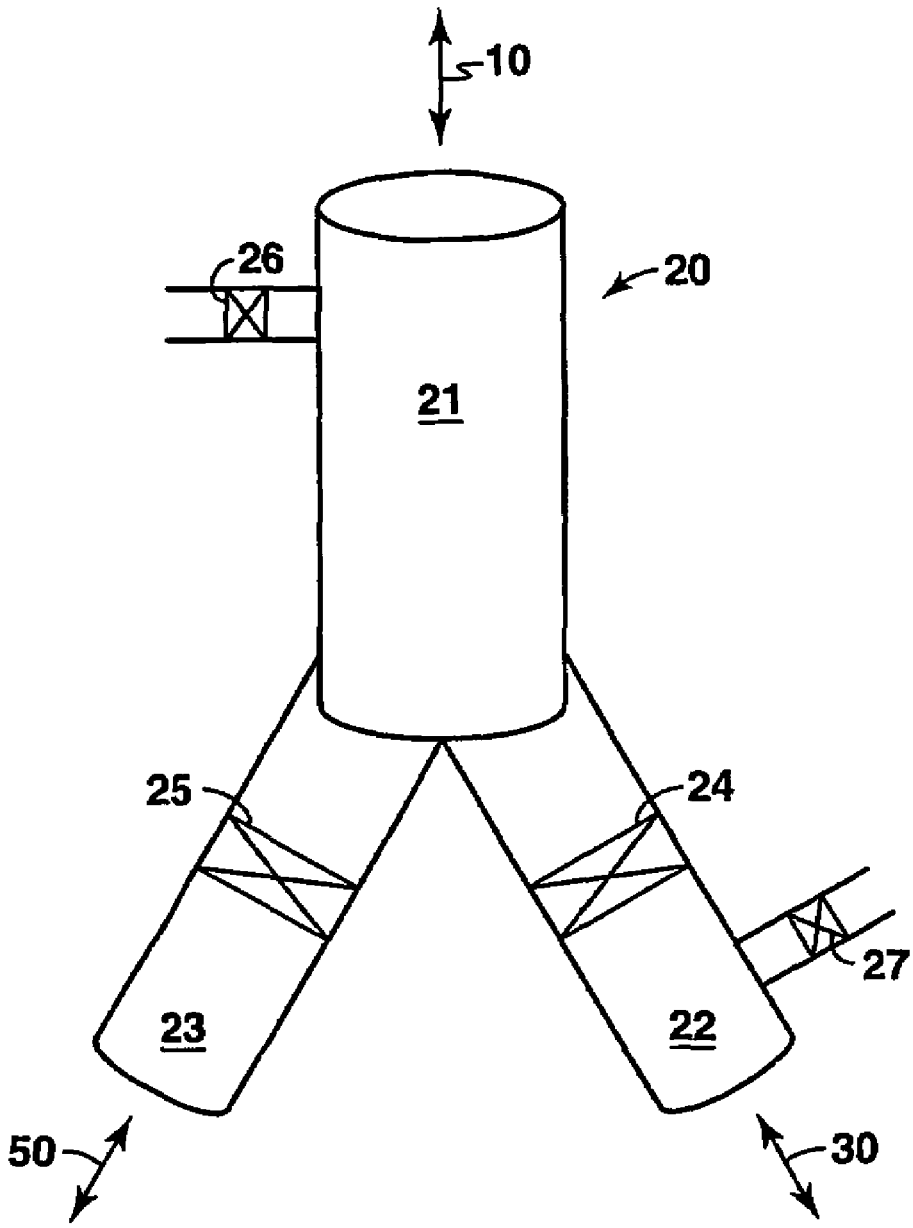
FIG. 6 is a diagram of the "Y" joint of the current invention.

The "Y" joint 20 has the following features. As shown in FIG. 6, the two flowline branches 22 and 23 of the "Y" are each outfitted with shut-off valves 24 and 25, to control fluid flow between the riser 10 and the respective ends of the flowline loop 60 depicted by flowlines 30 and 50 in FIG. 6. The "Y" joint 20 is also outfitted with two injection valves: a main injection valve 26 and a pigging injection valve 27. The main injection valve 26 may be located on the stem or riser end 21 of the "Y" joint 20. The pigging injection valve 27 may be located on one of the flowline branches, either 22 or 23 of the "Y" joint 20. The pigging injection valve 27 may be located on the downstream side of the shut-off valve (24 or 25), i.e. the shut-off valve (24 or 25) may be located between the riser 10 and the pigging injection valve 27. For this illustration, the pigging injection valve 27 is located on flowline branch 22, which hereinafter will be referred to as the "active" flowline branch 22. The other flowline branch, i.e. the flowline branch without the pigging injection valve is referred to as the "passive" flowline branch 23. The shut-off valves and injection valves located on the "Y" joint 20 may be any suitable valve including those that are common in the industry, and the selection of the appropriate valves for this invention can be made by one of ordinary skill in the art.

The following is a description of a method for pigging the flowline-riser system described above to produce hydrocarbons. The hydrocarbons are produced through the subsea wells, shown in FIG. 3 as wells 35 and 45, and pass through a production tree (not shown) and into the flowline loop 60. The hydrocarbons exit the flowline loop 60 via open shut off valve(s) 24 and/or 25 in "Y" joint 20, and enter into the riser 10 where the hydrocarbons are transported to the host production facility 5 for processing. Optionally, to enhance hydrocarbon recovery from the subsea reservoir, the main injection valve 26 located on the stem 21 of "Y" joint 20 may be used as a point to inject riser gas to help maximize hydrocarbon recovery. "Gas lifting" is commonly practiced in the industry, and can be readily accomplished by one of ordinary skill in the art using the main injection valve 26 as the injection point.

To pig the flowline-riser system of the current invention, a pig is sent from the host production facility 5 down the riser 10, directed into the "active" flowline branch 22 of the "Y" joint 20, sent through the flowline loop 60 and into the "passive" flowline branch 23 of the "Y" joint 20, and returned to the host production facility 5 through the same riser 10.

Figure 7D:
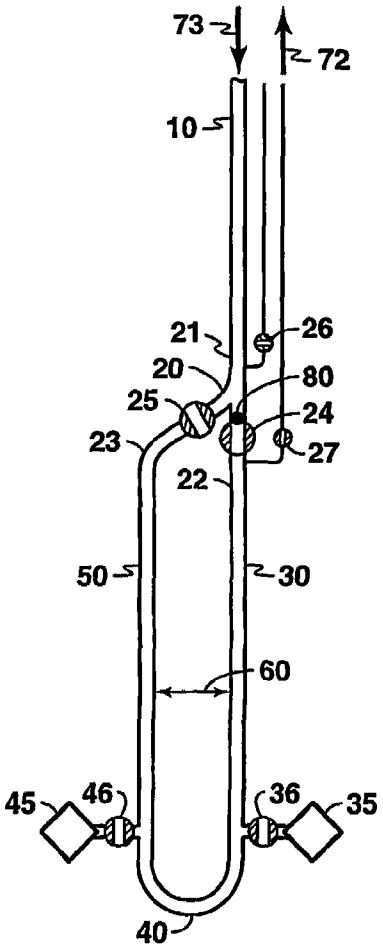
FIGS. 7*a* through 7*h* depict steps used in pigging a piggable system according to one embodiment of the invention.
Figure 7C:
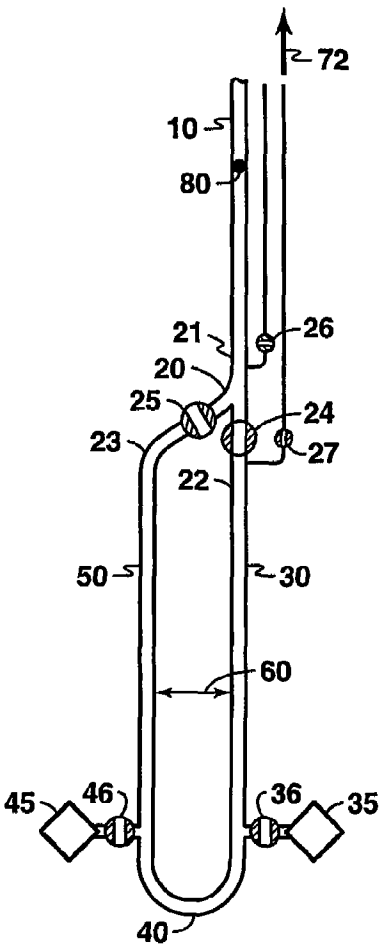

More particularly, to pig the flowline-riser system of the current invention the following procedures can be used. FIG. 7*a* displays an exemplary flowline-riser system according to one embodiment of the invention during normal production operations. Well shut-in valves 36 and 46 are open to allow fluids produced from wells 35 and 45 to flow into flowline loop 60. The shut-off valves 24 and 25 located on flowline branches 22 and 23 may also be placed in an open position to allow produced fluids 71 to flow through the riser 10 to the production facility. Alternatively, one shut-off valve 24 or 25 may be open while the other shut-off valve remains closed. Main injection valve 26 may be closed during normal production operations or opened if gas lift operations are desired. Pigging injection valve 27 may be closed during normal production operations.

Figure 7B:
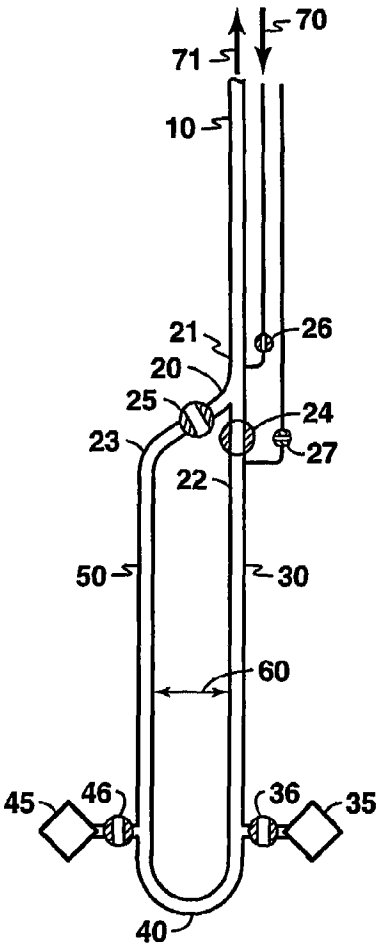
Figure 7A:
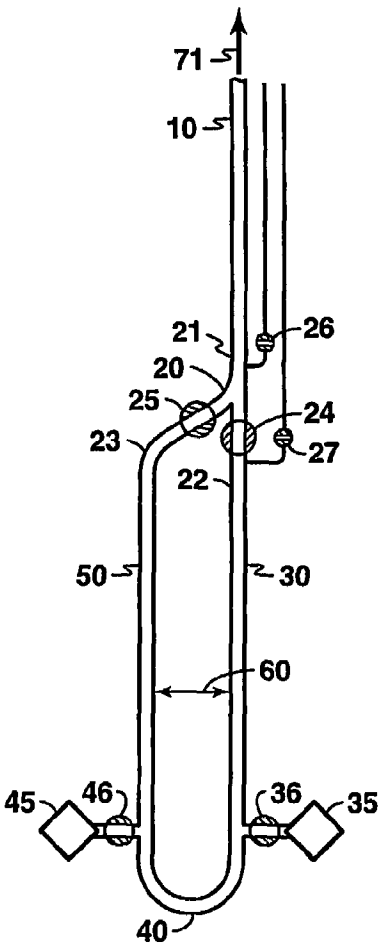

As depicted in FIG. 7*b*, to begin the pigging process the subsea wells 35 and 45 are "shut in", i.e. hydrocarbon production from the subsea wells 35 and 45 is stopped by activation of well shut-in valves 36 and 46 which may be located in the production tree. The shut-off valve 25 for the passive flowline branch 23 is closed (if not already closed), and the shut-off valve 24 on the active flowline branch 22 is opened (if not already open). The liquid 71 from riser 10 is removed, and system pressure reduced, by injecting lift gas 70 at the main injection valve 26. The pig 80 is then launched, FIG. 7*c*, from the host production facility 5, down the riser 10. Gravity will drive the pig 80 down the riser 10, or if necessary, injected fluid 73 above the pig 80 may be used as a pusher fluid. Fluid 72 below the pig 80 can be returned to the platform through injection valve 27. The pig 80 will enter into the stem 21 of the "Y" joint 20 and into the open active flowline branch 22 through open shut-off valve 24, FIGS. 7*d* & *e*. If necessary, the pig 80 can be pushed beyond injection valve 27 by compressing the gas and liquid in the flowline loop 60. The shut-off valve 24 on the active flowline branch 22 is then closed behind the pig 80, and the shut-off valve 25 on the passive flowline branch 23 is opened. Pigging fluid 73 may then be injected into the active flowline branch 22 through the pigging injection valve 27 and fluids in front of the pig 80 are thereafter pushed through loop 60 into riser 10 and out to the production facility. Any pigging fluid may be used, including but not limited to diesel, methanol or gas to propel the pig through the flowline.

Figures 7E, 7F, 7G, 7H:
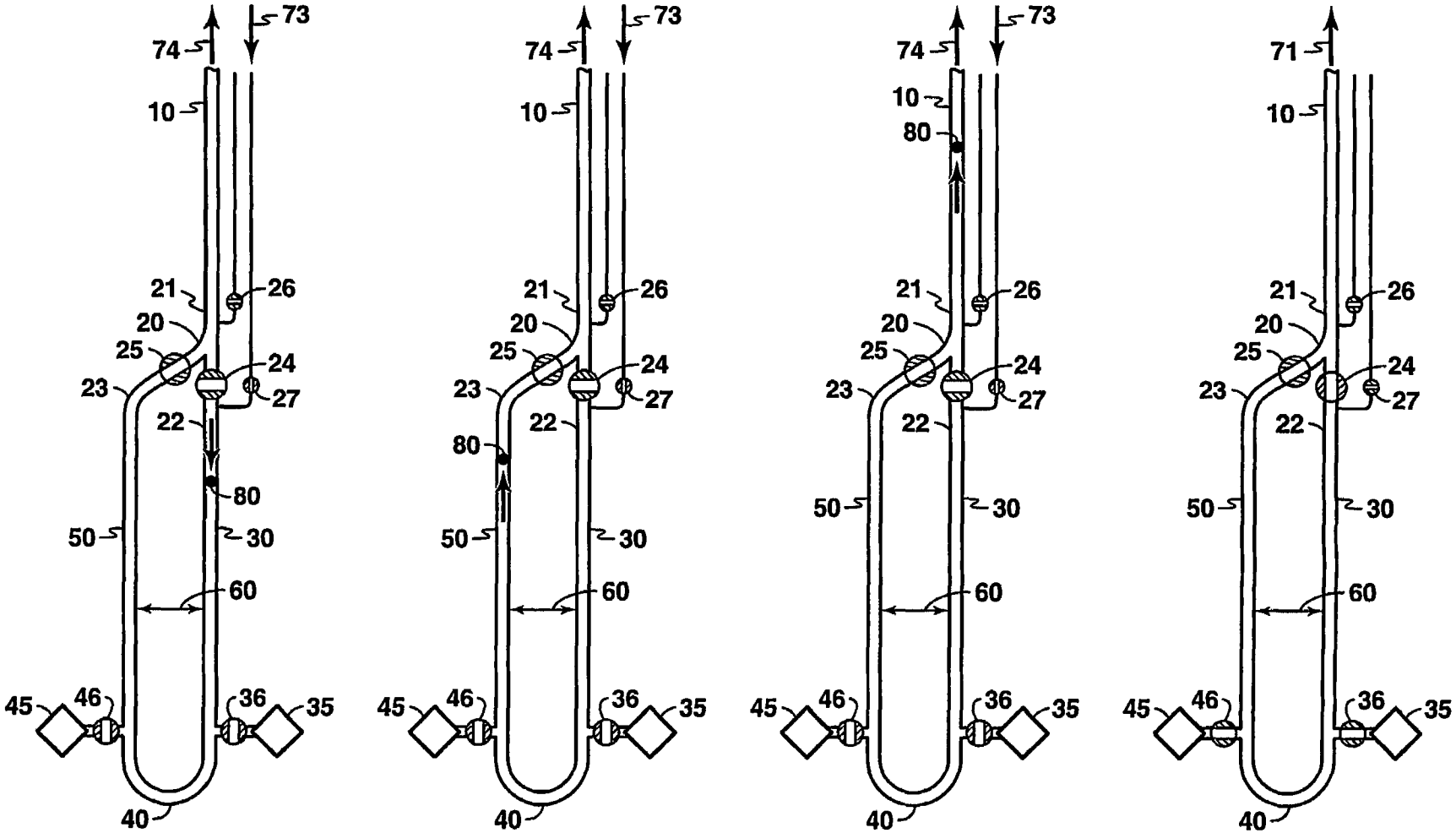

The main injection valve 26 may be opened to gas lift the fluids coming through the loop, thereby reducing the pressure in front of the pig 80. The position of the pig 80 may be monitored, such that when the pig 80 passes a production well or well center (e.g. wells 35 and 45), the well(s) can be brought on-stream to aid in "pushing" the pig 80. Monitoring devices, such as electronic or magnetic-pulsing transmitters on the pig with receivers on the line, may be used to detect the location of pigs within lines. The pig 80, once through flowline loop 60, will enter back into the "Y" joint 20 through the passive flowline branch 23, FIG. 7*f*. The pig will exit the "Y" joint 20 through stem 21 into the riser 10 where it will return to host production facility 5, FIG. 7*g*. The shut off valve 24 in the active flowline branch 22, can then be opened to resume normal production operations.

Figure 8:
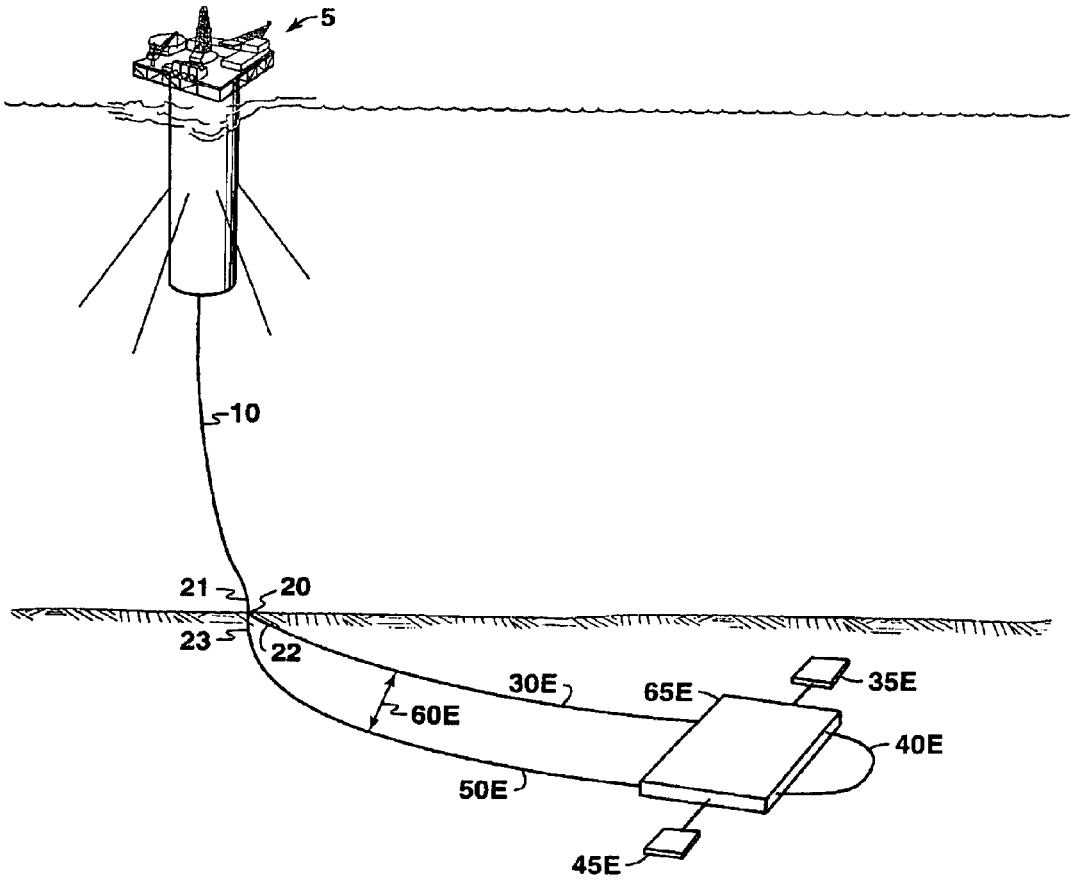
FIG. 8. is a diagram of an embodiment of the current invention, featuring a piggable system comprising a riser, a "Y" joint and a looped flowline including a manifold.

FIG. 8. Depicts an embodiment of the flowline-riser system with a host surface facility 5, a riser 10 and a looped flowline 60E at the base of the riser 10 is a specialty hardware device called a piggable "Y" joint 20. The stem 21 of the "Y" joint 20 is connected to and is in fluid communication with the riser 10. The two branches 22 and 23 of the "Y" joint 20 are connected to and in fluid communication with flowlines 30E and 50E respectively, which form the two ends of flowline loop 60E. The embodiment of FIG. 8. also includes a manifold 65E incorporated into flowline loop 60E. The manifold 65E may be used to receive fluids produced from wells 35E and 45E and distribute the produced fluids to flowlines 30E and 50E of the flowline loop 60E. Pigging loop 40E provides a means for the passing of a pig between flowlines 30E and 50E.

The apparatus and methodologies described herein may be used in producing offshore hydrocarbon resources. The piggable flowline-riser system may be used in combination with an offshore structure to produce hydrocarbon resources. The offshore structure may be, for example, a classic spar (e.g. a deep draft caisson vessel ("DDCV") or a truss spar) that is equipped with a deck and a production or export riser. In the case of the spar, the deck can support offshore hydrocarbon resource (i.e. oil and gas) production equipment for the production of oil and gas natural resources. Produced oil and/or gas may then be offloaded from the deck by, for example, pipeline to shore or a transport ship or barge and then moved to shore. The oil and gas may then be refined into usable petroleum products such as, for example, natural gas, liquefied petroleum gas, gasoline, jet fuel, diesel fuel, heating oil or other petroleum products.

Although some of the dependent claims have single dependencies in accordance with U.S. practice, each of the features in any of such dependent claims can be combined with each of the features of one or more of the other dependent claims dependent upon the same independent claim or claims.

The present invention has been described in connection with its preferred embodiments. However, to the extent that the foregoing description is specific to a particular embodiment or a particular use of the invention, this is intended to be illustrative only and is not to be construed as limiting the scope of the invention. On the contrary, it is intended to cover all alternatives, modifications, and equivalents that are included within the spirit and scope of the invention, as defined by the appended claims.

What is claimed is:

1. A piggable flowline-riser system comprising:

a) a Y joint having a stem, a first branch, and a second branch;

b) a riser in fluid communication with said stem of said Y joint;

c) a looped flowline in fluid communication with at least one production well, wherein said looped flowline has a first end and a second end, said first end in fluid communication with said first branch of said Y joint, and said second end in fluid communication with said second branch of said Y joint; and d) a gas injection line connected to and in fluid communication with said riser, wherein a pig inserted into said riser is transported through said looped flowline and returned into said riser.

2. A piggable flowline-riser system according to claim 1, further comprising:

e) a first shut-off valve disposed in said first branch of said Y joint and a second shut-off valve disposed in said second branch of said Y joint.

3. A piggable flowline-riser system according to claim 2, further comprising:

f) a pigging fluid injection line connected to and in fluid communication with said first branch of said Y joint, wherein the pig is transported upon selective actuation of said shut-off valves, said gas injection line and said pigging fluid injection line.

4. A piggable flowline-riser system according to claim 1, further comprising:

e) a first shut-off means disposed in said first branch of said Y joint and a second shut-off means disposed in said second branch of said Y joint.

5. A piggable flowline-riser system according to claim 4, further comprising:

f) a means of gas injection connected to and in fluid communication with said riser.

6. A piggable flowline-riser system according to claim 5, further comprising:

g) a pigging fluid injection means connected to and in fluid communication with said first branch of said Y joint, wherein upon selective actuation of said shut-off means, said means of gas injection and said pigging fluid injection means, a pig inserted into said riser is transported through said looped flowline and returned into said riser.

7. A method for pigging a flowline-riser system, said flowline-riser system including a Y joint having a stem in fluid communication with a riser and two branches, each of said branches in fluid communication with one of the ends of a flowline loop, said flowline loop being in fluid communication with at least one subsea production well, said riser having a gas injection line connected to and in fluid communication with said riser, said method comprising:

a) ceasing hydrocarbon production from said at least one subsea production well, b) injecting a pig into said riser, c) passing said pig from said riser through said Y joint and into said looped flowline, d) returning said pig from said looped flowline into said Y joint, and e) passing said pig from said Y joint into said riser.

8. The method of claim 7, wherein said pig is injected into said riser from a host production facility.

9. The method of claim 7, wherein said pig passes through said Y joint by selective activation of a pair of shut-off valves disposed within said Y joint.

10. The method of claim 7, wherein said pig passes through said Y joint by selective activation of a pair of shut-off means disposed within said Y joint.

11. The method of claim 7, wherein said pig is aided through said looped flowline by injecting pigging injection fluid into said Y joint.

12. The method of claim 7, further comprising injecting lift gas into said riser prior to injecting said pig into said riser.

13. The method of claim 7, further comprising injecting lift means into said riser prior to injecting said pig into said riser.

14. The method of claim 7, further comprising injecting lift gas into said riser after injecting said pig into said riser.

15. The method of claim 7, wherein said hydrocarbon production is continued from said production well after said pig passes said production well.

16. The method of claim 7, further comprising producing hydrocarbon resources from said at least one subsea production well.

17. The method of claim 16, further comprising transporting said produced hydrocarbon resources to land.

* * * * *